US012644604B2

(12) United States Patent
Nath et al.

(10) Patent No.: US 12,644,604 B2
(45) Date of Patent: Jun. 2, 2026

(54) PILOT FUEL NOZZLE ASSEMBLY WITH VENTED VENTURI

(71) Applicant: General Electric Company, Schenectady, NY (US)

(72) Inventors: Hiranya Nath, Bengaluru (IN); Steven C. Vise, Loveland, OH (US); Michael A. Benjamin, Cincinnati, OH (US); Gurunath Gandikota, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 25 days.

(21) Appl. No.: 17/327,177

(22) Filed: May 21, 2021

(65) Prior Publication Data

US 2022/0373182 A1 Nov. 24, 2022

(51) Int. Cl.

| | |
|---|---|
| ***F23R 3/00*** | (2006.01) |
| ***F23D 14/24*** | (2006.01) |
| ***F23D 14/58*** | (2006.01) |
| ***F23R 3/34*** | (2006.01) |

(52) U.S. Cl.
CPC ..... *F23R 3/343* (2013.01); *F23D 14/24* (2013.01); *F23D 14/58* (2013.01)

(58) Field of Classification Search
None
See application file for complete search history.

(56) References Cited

U.S. PATENT DOCUMENTS

| | | | | |
|---|---|---|---|---|
| 2,933,259 | A * | 4/1960 | Raskin | F23D 14/58 239/431 |
| 4,327,547 | A * | 5/1982 | Hughes | F23D 11/12 60/39.463 |
| 5,253,478 | A * | 10/1993 | Thibault, Jr. | F23R 3/14 60/753 |
| 5,288,021 | A | 2/1994 | Sood et al. | |
| 6,389,815 | B1 * | 5/2002 | Hura | F23R 3/346 60/746 |
| 6,547,163 | B1 * | 4/2003 | Mansour | B05B 1/3421 239/404 |
| 7,007,864 | B2 | 3/2006 | Snyder et al. | |

(Continued)

FOREIGN PATENT DOCUMENTS

| | | | |
|---|---|---|---|
| CN | 101435585 | A | 5/2009 |
| GB | 1307634 | A | 2/1973 |

*Primary Examiner* — Edwin Kang
(74) *Attorney, Agent, or Firm* — Venable LLP; Edward A. Kmett; Michele V. Frank

(57) ABSTRACT

A pilot fuel nozzle assembly includes a fuel nozzle, a swirler, and a vented pilot venturi. The vented pilot venturi has an annular wall with an oxidizer flow passage therein. An expansion flow surface portion of the venturi has a larger diameter at an outlet than at a throat of the venturi. A plurality of venturi oxidizer outlet ports extend through the expansion flow surface to the oxidizer flow passage within the annular wall to provide a flow of oxidizer through the venturi wall into a mixing cavity of the venturi and at an outlet end of the venturi. The oxidizer outlet ports are circumferentially spaced about a circumference of the expansion flow surface, and may be arranged in a plurality of rows. The oxidizer outlet ports may be angled with respect to the expansion flow surface and may angled circumferentially in a co-swirl direction with the swirler.

17 Claims, 6 Drawing Sheets

(56) References Cited

U.S. PATENT DOCUMENTS

| | | | | |
|---|---|---|---|---|
| 7,762,070 | B2 | 7/2010 | Dawson et al. | |
| 8,387,391 | B2 | 3/2013 | Patel et al. | |
| 8,511,091 | B2 | 8/2013 | Goodwin | |
| 9,404,656 | B2 | 8/2016 | Burd | |
| 9,791,153 | B2 | 10/2017 | Dai et al. | |
| 10,054,312 | B2 | 8/2018 | Dai et al. | |
| 10,094,567 | B2 * | 10/2018 | Igarashi | F23R 3/286 |
| 10,591,164 | B2 * | 3/2020 | Patel | F23R 3/34 |
| 2005/0115244 | A1 * | 6/2005 | Griffin | F23R 3/286 60/737 |
| 2006/0196188 | A1 * | 9/2006 | Burd | F23R 3/002 60/754 |
| 2008/0178598 | A1 | 7/2008 | Commaret et al. | |
| 2010/0050644 | A1 * | 3/2010 | Pidcock | F23R 3/343 60/737 |
| 2010/0162713 | A1 * | 7/2010 | Li | F23R 3/286 60/748 |
| 2010/0186417 | A1 * | 7/2010 | Blomeyer | F23R 3/283 239/398 |
| 2010/0251719 | A1 * | 10/2010 | Mancini | F23R 3/343 60/737 |
| 2010/0263382 | A1 * | 10/2010 | Mancini | F23R 3/14 60/742 |
| 2010/0269506 | A1 * | 10/2010 | Nonaka | F23D 11/386 60/742 |
| 2014/0144144 | A1 * | 5/2014 | Hirata | F23R 3/286 60/738 |
| 2014/0331676 | A1 * | 11/2014 | Cramb | F23R 3/14 60/740 |
| 2014/0338339 | A1 * | 11/2014 | Westmoreland | F23R 3/286 60/737 |
| 2015/0128599 | A1 * | 5/2015 | Snyder | F23R 3/50 60/734 |
| 2016/0265780 | A1 * | 9/2016 | Patel | F23R 3/34 |
| 2016/0273776 | A1 * | 9/2016 | Takiguchi | F23R 3/34 |
| 2017/0003030 | A1 * | 1/2017 | Benjamin | F23D 11/386 |
| 2017/0191667 | A1 * | 7/2017 | Spivey | F23R 3/286 |
| 2017/0248318 | A1 * | 8/2017 | Kulkarni | F23R 3/46 |
| 2017/0307219 | A1 * | 10/2017 | Tsunoda | F23R 3/10 |
| 2018/0051567 | A1 * | 2/2018 | Bunker | F01D 25/14 |
| 2018/0106481 | A1 * | 4/2018 | Aurifeille | F02C 7/28 |
| 2018/0135859 | A1 * | 5/2018 | Sadasivuni | F23R 3/14 |

* cited by examiner

PILOT FUEL NOZZLE ASSEMBLY WITH VENTED VENTURI

TECHNICAL FIELD

The present disclosure relates to venturi of a pilot fuel nozzle assembly.

BACKGROUND

Some combustors in use are known as TAPS (Twin Annular Pre-mixing Swirler) combustors. TAPS combustors include a pre-mixer/swirler fuel nozzle assembly in which air and fuel are mixed. The TAPS pre-mixer/swirler fuel nozzle assembly includes both a pilot swirler and a main pre-mixer. The pilot swirler includes a venturi into which a fuel/air mixture is injected by a pilot fuel nozzle and surrounding air swirlers. The fuel/air mixture exits the venturi into a combustion chamber, where it is ignited and burned. At the outlet end of the venturi, a heat shield is generally provided to protect the fuel nozzle assembly. An aft surface of the heat shield facing the combustion chamber is subject to high temperatures from the burning fuel/air mixture exiting the venturi.

BRIEF SUMMARY

According to one aspect, the present disclosure relates to a pilot fuel nozzle assembly for a combustor of a gas turbine engine. The pilot fuel nozzle assembly includes a pilot fuel nozzle, a pilot oxidizer inlet disposed about the pilot fuel nozzle, a pilot oxidizer swirler disposed downstream of the pilot oxidizer inlet, the pilot oxidizer swirler providing a swirling flow of oxidizer in a pilot swirl direction about a fuel nozzle centerline axis, and a vented pilot venturi disposed radially outward of the pilot oxidizer swirler and in fluid communication with the pilot oxidizer inlet. The vented pilot venturi includes, an annular wall extending circumferentially about the fuel nozzle centerline axis, and extending in a longitudinal direction along the fuel nozzle centerline axis from an inlet end of the vented pilot venturi to an outlet of the vented pilot venturi. The annular wall has an oxidizer flow passage within the annular wall, the oxidizer flow passage extending from the inlet end of the vented pilot venturi to an outlet end of the vented pilot venturi adjacent to the outlet. The oxidizer flow passage being in fluid communication with the pilot oxidizer inlet.

Further, according to this aspect of the disclosure, the annular wall defines an inner venturi surface defining a flow opening through the vented pilot venturi. The inner venturi surface includes (a) a throat area disposed between the inlet end of the vented pilot venturi and the outlet of the vented pilot venturi, the throat area having a smaller diameter than a remaining portion of the inner venturi surface downstream of the throat area, and (b) an expansion flow surface portion disposed, in the longitudinal direction, from the throat area to the outlet of the vented pilot venturi, the expansion flow surface portion have a first diameter at the throat area and a second diameter at the outlet, the second diameter being larger than the first diameter. The annular wall further defines a plurality of venturi oxidizer outlet ports extending from the oxidizer flow passage through the expansion flow surface portion, the plurality of venturi oxidizer outlet ports being circumferentially spaced about the fuel nozzle centerline axis.

According to another aspect, the present disclosure relates to a vented pilot venturi for a pilot fuel nozzle assembly of a gas turbine engine. The vented pilot venturi includes an annular wall extending circumferentially about a venturi centerline axis, and extending in a longitudinal direction along the venturi centerline axis from an inlet end of the vented pilot venturi to an outlet of the vented pilot venturi, and an oxidizer flow passage within the annular wall, the oxidizer flow passage extending from the inlet end of the vented pilot venturi to an outlet end of the vented pilot venturi adjacent to the outlet. The oxidizer flow passage has a flow passage inlet at the inlet end of the vented pilot venturi, an inner venturi surface defining a flow opening through the vented pilot venturi. The inner venturi surface includes (a) a throat area disposed between the inlet end of the vented pilot venturi and the outlet of the vented pilot venturi, the throat area having a smaller diameter than a remaining portion of the inner venturi surface downstream of the throat area, and (b) an expansion flow surface portion disposed, in the longitudinal direction, from the throat area to the outlet of the vented pilot venturi, the expansion flow surface portion have a first diameter at the throat area and a second diameter at the outlet, the second diameter being larger than the first diameter. A plurality of venturi oxidizer outlet ports extends from the oxidizer flow passage through the expansion flow surface portion, the plurality of venturi oxidizer outlet ports being circumferentially spaced about the venturi centerline axis.

Additional features, advantages, and embodiments of the present disclosure are set forth or apparent from consideration of the following detailed description, drawings, and claims. Moreover, it is to be understood that both the foregoing summary and the following detailed description are exemplary and intended to provide further explanation without limiting the scope of the disclosure as claimed.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

TAPS combustors are known to include a fuel nozzle assembly that has a pilot swirler that includes a venturi. The pilot swirler ejects a fuel/air mixture into the venturi, which then flows into a combustion chamber, where it is ignited and burned. At the outlet end of the venturi, a heat shield is generally provided to protect the fuel nozzle assembly. The heat shield conventionally includes a flange in which cooling air is provided to the forward surface to cool the flange, and some of the cooling air is also provided to the aft surface.

The present disclosure is of a fuel nozzle architecture without a dedicated heat shield and with a vented venturi feature. More specifically, the present disclosure provides for a vented venturi as part of the pilot fuel nozzle assembly, where the arrangement of the vented venturi reduces high temperatures on the venturi surface. According to the present disclosure, the vented venturi has an air flow passage within a venturi wall and a plurality of rows of oxidizer outlet ports that extend through the wall of the venturi from the air flow passage to the inner surface of the venturi. The flow of oxidizer within the air flow passage and through the oxidizer outlet ports provides cooling air to the inner surface of the venturi, and also to an outer end portion of the venturi. The oxidizer outlet ports are circumferentially spaced in a circumferential direction about a circumference of the venturi inner surface, and about the circumference of the outlet end of the venturi.

Figure 1:
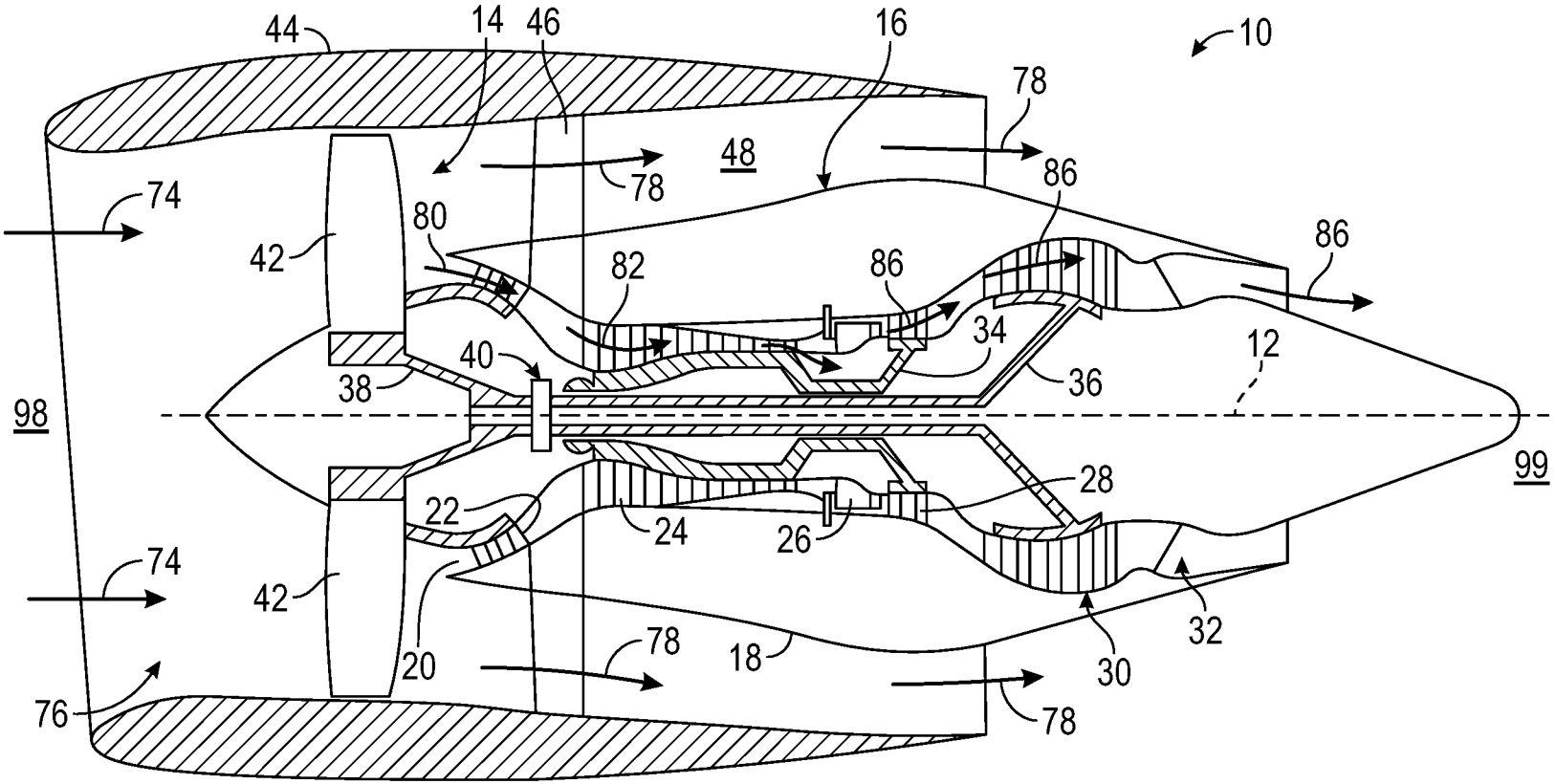
FIG. 1 is a schematic partial cross-sectional side view of an exemplary high by-pass turbofan jet engine, according to an aspect of the present disclosure.

Referring now to the drawings, FIG. 1 is a schematic partial cross-sectional side view of an exemplary high by-pass turbofan jet engine 10, herein referred to as "engine 10," as may incorporate various embodiments of the present disclosure. Although further described below with reference to a turbofan engine, the present disclosure is also applicable to turbomachinery in general, including turbojet, turboprop, and turboshaft gas turbine engines, including marine and industrial turbine engines and auxiliary power units. As shown in FIG. 1, engine 10 has a longitudinal or axial centerline axis 12 that extends therethrough from an upstream end 98 to a downstream end 99 for reference purposes. In general, engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40, such as in an indirect-drive or a geared-drive configuration. In other embodiments, although not illustrated, the engine 10 may further include an intermediate pressure (IP) compressor and a turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially spaced outlet guide vanes or struts 46. Moreover, at least a portion of the nacelle 44 may extend over an outer portion of the core engine 16 so as to define a bypass airflow passage 48 therebetween.

Figure 2:
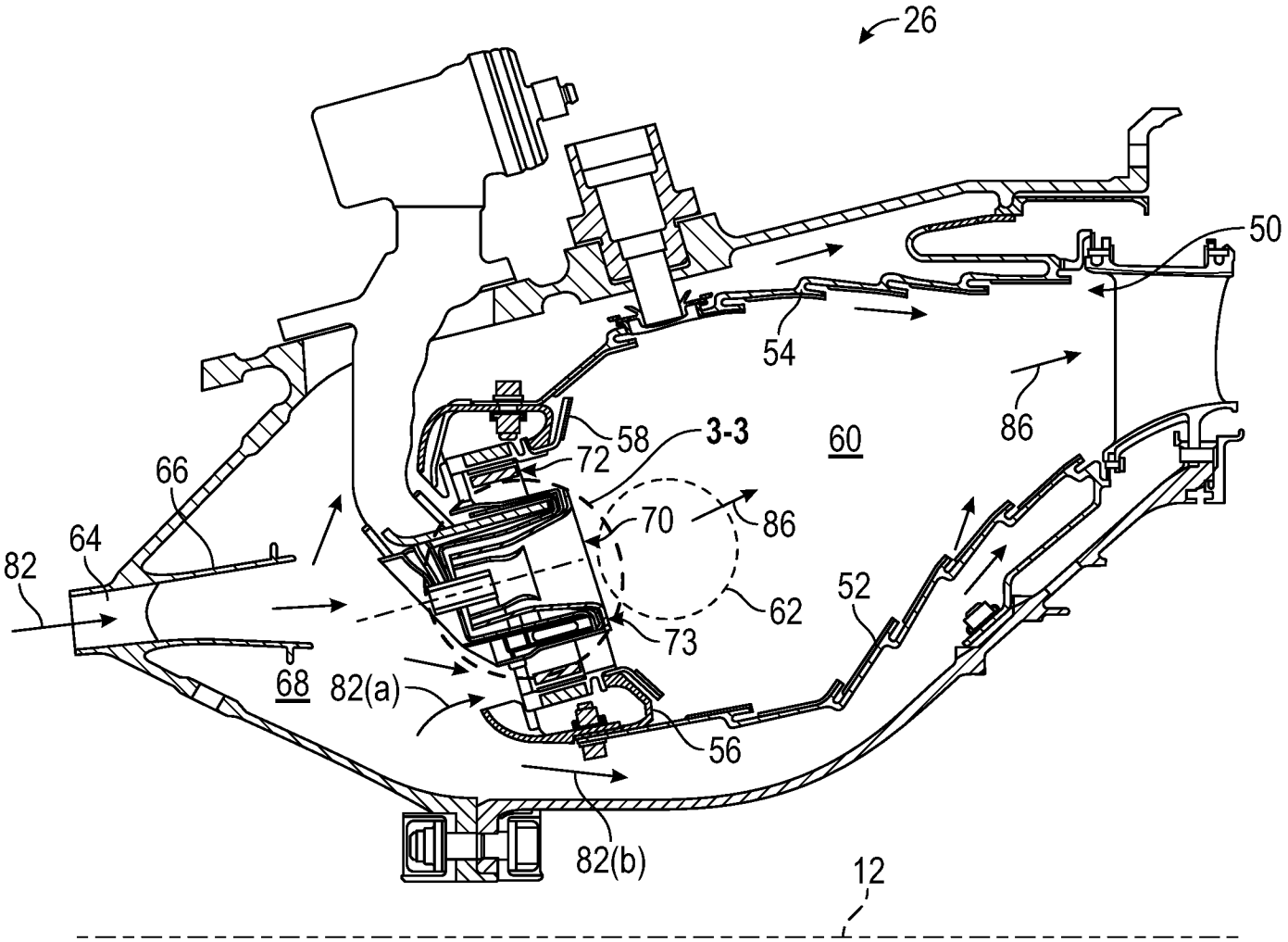
FIG. 2 is a partial cross-sectional side view of an exemplary combustion section, according to an aspect of the present disclosure.

FIG. 2 is a partial cross-sectional side view of an exemplary combustion section 26 of the core engine 16 as shown in FIG. 1. The combustion section 26 in FIG. 2 is depicted as an exemplary Twin Annular Pre-mixing Swirler (TAPS) type combustor section. However, the present disclosure can be implemented in other combustor types, and the TAPS combustion section is merely exemplary. As shown in FIG. 2, the combustion section 26 may generally include an annular type combustor assembly 50 having an annular inner liner 52, an annular outer liner 54, a bulkhead wall 56, and a dome assembly 58, together defining a combustion chamber 60. The combustion chamber 60 may more specifically define a region defining a primary combustion zone 62 at which initial chemical reaction of a fuel-oxidizer mixture and/or recirculation of combustion gases 86 may occur before flowing further downstream, where mixture and/or recirculation of combustion products and air may occur before flowing to the HP and LP turbines 28, 30. The combustor assembly 50 also includes a pre-mixer/fuel nozzle assembly, referred to herein as pilot fuel nozzle assembly, 70 that has a pilot fuel nozzle portion 73 and a main pre-mixer portion 72. As will be described below, the pilot fuel nozzle portion 73 includes a pilot fuel nozzle and pilot air swirlers that produce a swirled pilot fuel/air mixture that is ejected into a pilot venturi, and then into the combustion chamber 60, where it is burned to produce combustion gases 86. The pilot fuel nozzle portion 73 generally operates at all operating conditions of the engine 10. The main pre-mixer portion 72 has main fuel nozzles and main air swirlers that produce a main fuel/air mixture that is ejected into the combustion chamber 60, where it is also ignited and burned. The main pre-mixer portion 72 generally operates at higher power operations of the engine 10.

During operation of the engine 10, as shown in FIGS. 1 and 2 collectively, a volume of air, as indicated schematically by arrows 74, enters the engine 10 from upstream end 98 through an associated inlet 76 of the nacelle 44 and/or fan assembly 14. As the inlet air 74 passes across the fan blades 42, a portion of the air as indicated schematically by arrows 78 is directed or routed into the bypass airflow passage 48, while another portion of the air, as indicated schematically by arrow 80, is directed or routed into the LP compressor 22. Air 80 is progressively compressed as it flows through the LP and HP compressors 22, 24 towards the combustion section 26. As shown in FIG. 2, the now compressed air, as indicated schematically by arrow 82, flows across a compressor exit guide vane (CEGV) 64 and through a pre-diffuser 66 into a diffuser cavity 68 of the combustion section 26.

The compressed air 82 pressurizes the diffuser cavity 68. A first portion of the compressed air 82, as indicated schematically by arrows 82(*a*), flows from the diffuser cavity 68 into the pilot fuel nozzle assembly 70, where it is premixed with fuel and ejected from pilot fuel nozzle assembly 70 and burned, thus generating combustion gases, as indicated schematically by arrows 86, within the primary combustion zone 62 of the combustor assembly 50. Typically, the LP and HP compressors 22, 24 provide more compressed air to the diffuser cavity 84 than is needed for combustion. Therefore, a second portion of the compressed air 82, as indicated schematically by arrows 82(*b*), may be used for various purposes other than combustion.

Referring back to FIGS. 1 and 2 collectively, the combustion gases 86 generated in the combustion chamber 60 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive at downstream end 99.

Figure 3:
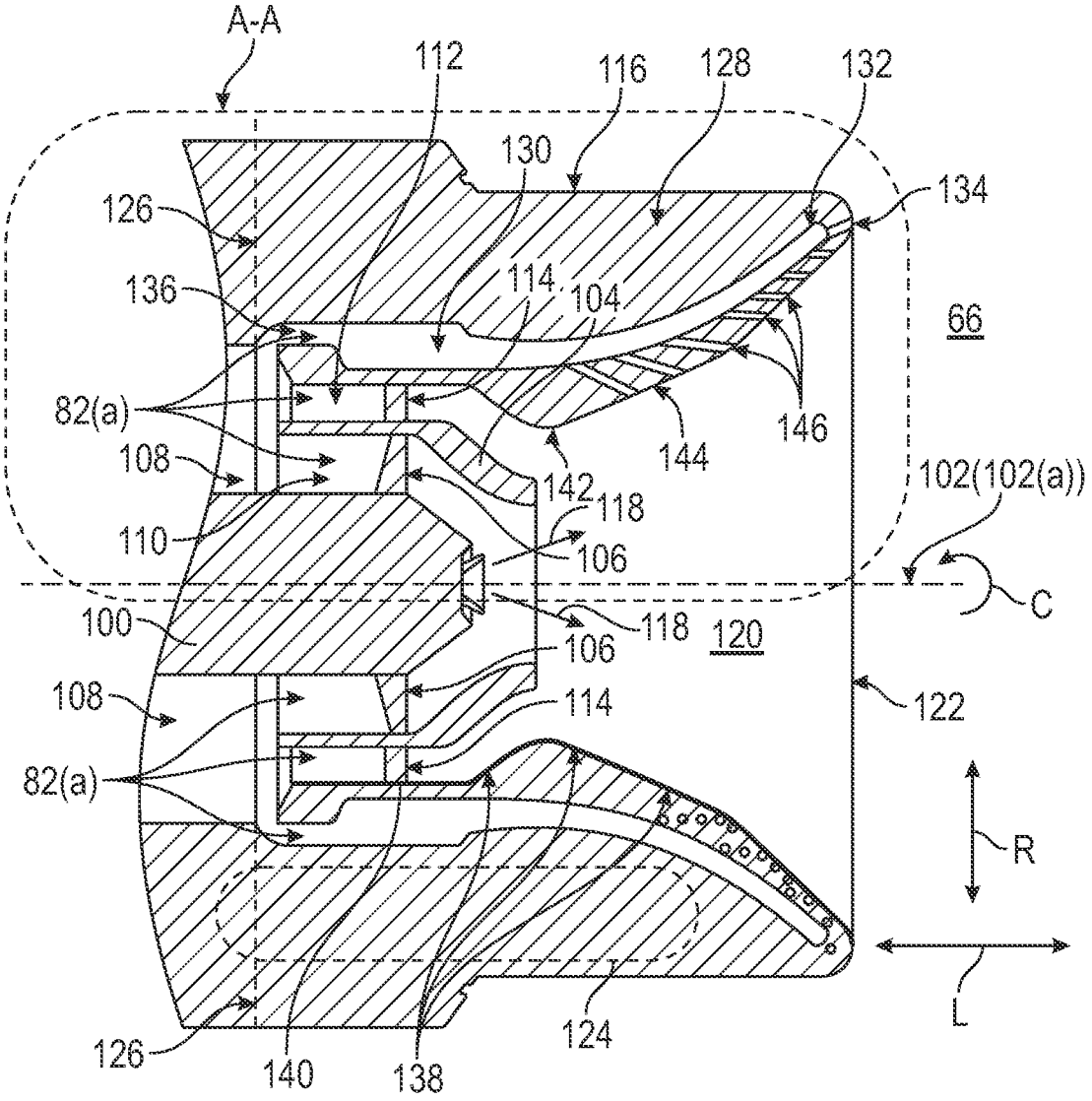
FIG. 3 is a partial cross-sectional side view of an exemplary pilot fuel nozzle assembly, according to an aspect of the present disclosure.

FIG. 3 is a partial cross-sectional side view of an exemplary pilot fuel nozzle portion 73, taken at detail 3-3 in FIG. 2. Referring briefly to FIG. 8, depicted therein is a partial perspective cross-sectional view of the pilot fuel nozzle portion 73 shown in FIG. 3. It is noted that, in FIG. 2, the pilot fuel nozzle assembly 70 includes both the pilot fuel nozzle portion 73, and the main pre-mixer portion 72 attached thereto. The main pre-mixer portion 72 is not depicted in FIGS. 3 and 7 and only the pilot fuel nozzle portion 73 is depicted therein. The pilot fuel nozzle portion 73 is seen to include a pilot oxidizer inlet 108 and a pilot fuel nozzle 100 aligned along centerline axis 102. The centerline axis 102 may also be referred to herein as a venturi centerline axis 102(*a*). In FIG. 3, the pilot fuel nozzle 100 is merely shown as a general representation of a pilot fuel nozzle and internal component parts, such as a fuel line, etc., that are known to form a pilot fuel nozzle in a TAPS-type pilot fuel nozzle, are omitted.

The pilot fuel nozzle 100 is surrounded by a pilot splitter 104, which is separated from the pilot fuel nozzle 100 by a pilot inner air passage 110. Positioned within the pilot inner air passage 110 are inner air passage swirl vanes 106. Surrounding the pilot splitter 104 is a vented pilot venturi 116, which will be described in more detail below. A pilot outer air passage 112 is formed between the pilot splitter 104 and the vented pilot venturi 116, with outer air passage swirl vanes 114 disposed within the pilot outer air passage 112. In operation, air 82(*a*) enters the pilot oxidizer inlet 108, and the flow of the air 82(*a*) is separated by the pilot splitter 104 between the pilot inner air passage 110 and the pilot outer air passage 112. A swirl is induced into the air 82(*a*) flowing through the pilot inner air passage 110 and pilot outer air passage 112 by the inner air passage swirl vanes 106 and outer air passage swirl vanes 114. Thus, the pilot splitter 104, inner air passage swirl vanes 106, and outer air passage swirl vanes 114, function as a pilot oxidizer swirler 115. The swirled airflow mixes with fuel 118 ejected from the pilot fuel nozzle 100 in an open cavity portion 120 of the vented pilot venturi 116 to produce a swirled fuel/air mixture (not shown). The swirled fuel/air mixture is generally swirled circumferentially (C) about the open cavity portion 120 (i.e., swirled in a pilot swirl direction). The swirled fuel/air mixture within the open cavity portion 120 flows toward an outlet 122 of the vented pilot venturi 116, where it is ignited and burned within the combustion chamber 60.

The vented pilot venturi 116 will now be described in more detail. It is first noted that the vented pilot venturi 116, depicted in the drawings, omits some elements that may be included as part of the pilot fuel nozzle assembly 70 that are not necessary for an understanding of the pilot venturi 116. In particular, while the cross section of FIG. 3 depicts a generally solid area around the outer portion of the venturi (e.g., area 124), the area 124 may include elements such as a main fuel circuit and a main air flow passage that forms a part of the main pre-mixer portion 72. Such main fuel circuits and main air flow passages that form part of TAPS-type pre-mixer are known to those skilled in the art.

In FIG. 3, the vented pilot venturi 116 is seen to be formed of a generally annular wall 128 that extends, in the longitudinal direction (L), along the centerline axis 102 (102(*a*)) from a inlet end 126 to the outlet 122. The vented pilot venturi 116 also extends circumferentially about the centerline axis 102 (102(*a*)). The annular wall 128 includes an oxidizer flow passage 130 within the annular wall 128. The oxidizer flow passage 130 extends from the inlet end 126 of the vented pilot venturi 116 to an outlet end 132 of the vented pilot venturi 116 adjacent to the outlet 122. That is, the oxidizer flow passage 130 terminates within the annular wall 128 prior to the outlet 122 near a rounded outlet tip portion 134. The oxidizer flow passage 130 is in fluid communication with the pilot oxidizer inlet 108. That is, the inlet end of the vented pilot venturi 116 includes a flow passage inlet 136 in which the air 82(*a*) from the pilot oxidizer inlet 108 can enter the oxidizer flow passage 130.

The annular wall 128 further defines an inner venturi surface 138 that extends from the inlet end 126 of the venturi to the outlet 122 of the venturi, and the inner venturi surface 138 defines, at least in part, the open cavity portion 120 through the vented pilot venturi 116. The inner venturi surface 138 extends circumferentially about the centerline axis 102 (102(*a*)). The inner venturi surface 138 (depicted in bold for emphasis in FIG. 3) can generally be seen to include an upstream portion 140 that forms an outer surface of the pilot outer air passage 112, a throat area 142, and a venturi expansion surface 144 downstream of the throat area 142. Thus, the throat area 142 is disposed between the inlet end 126 of the vented pilot venturi 116 and the outlet 122 of the vented pilot venturi 116. The throat area 142 can be seen to have a smaller diameter 117 than a remaining portion of the venturi expansion surface 144 downstream of the throat area. That is, the venturi expansion surface 144 can be seen to be an expansion flow surface portion that expands in diameter as the inner venturi surface 138 progresses from the throat area 142 to the outlet 122. Accordingly, the venturi expansion surface 144, from the throat area 142 to the outlet 122 of the vented pilot venturi 116, includes a first diameter 117 at the throat area and a second diameter 119 at the outlet 122, where the second diameter 119 at the outlet 122 is larger than the first diameter 117 at the throat area 142.

Referring still to FIG. 3, the annular wall 128 further defines a plurality of oxidizer outlet ports 146. The oxidizer outlet ports 146 extend from the oxidizer flow passage 130 through the venturi expansion surface 144. Thus, the oxidizer outlet ports 146 are holes that allow the air 82(*a*) flowing through the oxidizer flow passage 130 in the annular wall to flow through the holes and into the open cavity portion 120. The oxidizer outlet ports 146 will be described in more detail below, but it can readily be seen that the plurality of oxidizer outlet ports 146 are circumferentially spaced in the circumferential direction (C) about the centerline axis 102 (120(*a*)).

Figure 4:
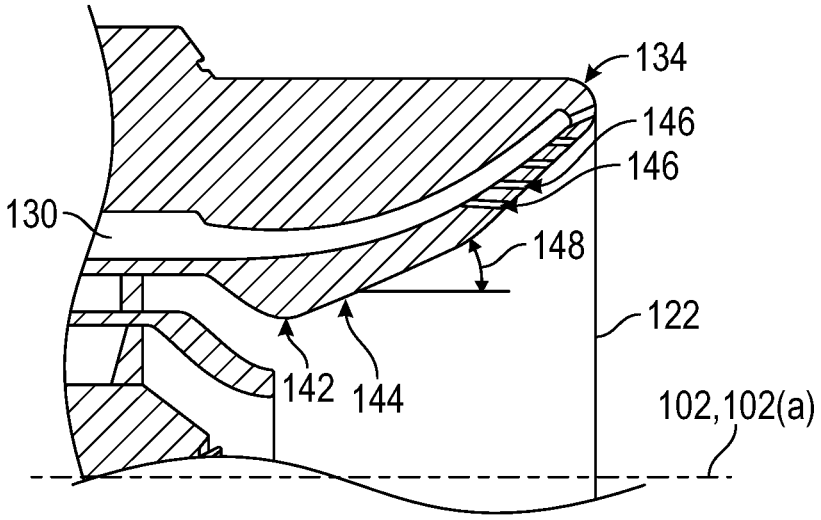
FIG. 4 is a partial cross-sectional side detail view of a portion of the fuel nozzle in FIG. 3, taken at detail A-A in FIG. 3, according to an aspect of the present disclosure.
Figure 5:
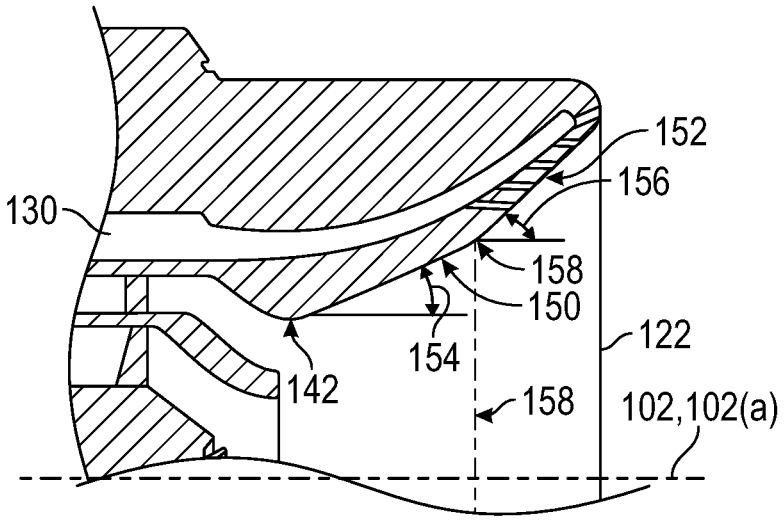
FIG. 5 is a partial cross-sectional side detail view of a portion of the fuel nozzle in FIG. 3, taken at detail A-A in FIG. 3, according to another aspect of the present disclosure.
Figure 6:
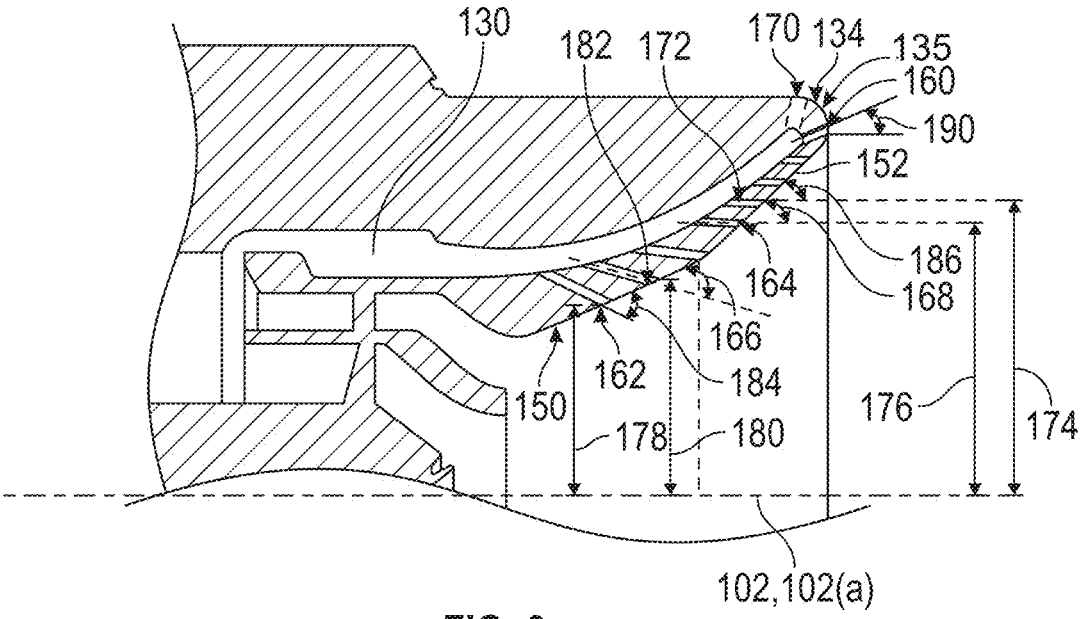
FIG. 6 is a partial cross-sectional side detail view of a portion of the fuel nozzle in FIG. 3, taken at detail A-A in FIG. 3, according to still another aspect of the present disclosure.

FIGS. 4 to 6 are enlarged views taken at detail A-A seen in FIG. 3. Referring to FIG. 4, the venturi expansion surface 144 can be seen to have a generally curved profile shape extending from the throat area 142 to the outlet 122. Alternatively, the venturi expansion surface 144 may be generally a conical-shaped portion (i.e., a conical-shaped surface) extending from the throat area 142 to the outlet 122. A half-angle 148 of the single conical-shaped venturi expansion surface 144 may have a range from fifteen degrees to forty degrees. Of course, the present disclosure is not limited to the foregoing range and other half-angles may be implemented instead.

FIG. 5 depicts an exemplary venturi expansion surface 144 that is a double-angled surface. That is, a first conical surface 150 of the venturi expansion surface 144 may be a generally conical-shaped surface that extends from the throat area 142 to a breakpoint 158 along the first conical surface 150. The first conical surface 150 may have a first conical half-angle 154. A second conical surface 152 of the venturi expansion surface 144 may also be a generally conical-shaped surface that extends from the breakpoint 158 to the outlet 122. The second conical surface 152 may have a second conical half-angle 156. In one aspect, the first conical half-angle may range from fifteen to thirty degrees, while the second conical half-angle may range from thirty to forty degrees. In another aspect, the first conical half-angle may range from thirty to forty degrees, while the second conical half-angle may range from fifteen to thirty degrees. Of course, the present disclosure is not limited to the foregoing ranges and other half-angles could be implemented instead. In addition, the expansion surface of the present disclosure is not limited to only two conical surfaces, and other arrangements may be implemented instead. For example, the first conical surface 150 may be implemented to the breakpoint 158, and a curved surface implemented downstream of the breakpoint. Alternatively, a curved surface may be implemented in place of the first conical surface 150 to the breakpoint 158, and then the second conical surface 152 may be included from the breakpoint 158 to the outlet 122. In addition, the present disclosure is not limited to dividing the venturi expansion surface 144 into two portions, but more than two portions could be implemented. For example, three conical surface portions could be implemented, where two separate breakpoints would be present between the conical surfaces.

FIG. 6 is an enlarged view taken at detail A-A in FIG. 3, depicting an arrangement of the venturi oxidizer outlet ports 146 as seen in FIG. 3. FIG. 6 is a depiction of the double-angled venturi expansion surface 144 that was described above with regard to FIG. 5. Thus, an arrangement of the oxidizer outlet ports 146 with respect to the double-angled expansion surface will be described. The first conical surface 150 is seen to include oxidizer outlet ports 162 and 182 (corresponding to the oxidizer outlet ports 146 of FIG. 3). Each of the oxidizer outlet ports 162 and 182 extend from the oxidizer flow passage 130 through the first conical surface 150. In the vented venturi of the present disclosure, a plurality of the oxidizer outlet ports 162 are arranged about the circumference of the first conical surface 150, and a plurality of the oxidizer outlet ports 182 are arranged about the circumference of the first conical surface 150. (See, e.g., FIGS. 7 and 8). The plurality of oxidizer outlet ports 162 arranged about the circumference of the first conical surface 150 may be referred to as a first row of oxidizer outlet ports, and the plurality of oxidizer outlet ports 182 arranged about the circumference of the first conical surface 150 can be referred to as a second row of oxidizer outlet ports. Collectively, the first and second rows of oxidizer outlet ports 162, 182 may be referred to as a first group of oxidizer outlet ports. In FIG. 6, the first row 194 (see, FIG. 7) of oxidizer outlet ports 162 can be seen to be arranged at a radial distance 178 from the centerline axis 102 (102(*a*)), while the second row 196 (see FIG. 7) of oxidizer outlet ports 182 can be seen to be arranged at a radial distance 180 different from the radial distance 178.

The oxidizer outlet port 162 is seen to be aligned at an angle 184 with respect to the first conical surface 150, in the longitudinal direction (L). The oxidizer outlet port 182 is seen to be aligned at an angle 166 with respect to the first conical surface 150, in the longitudinal direction (L). The angles 184 and 166 may be the same, or they may be different from one another. In some aspects of the present disclosure, the angles 184 and 166 may have a range from twelve degrees to thirty degrees. Of course, the present disclosure is not limited to the foregoing range and the angles 184 and 166 may be arranged at other angles instead.

The second conical surface 152 is seen to include oxidizer outlet ports 164 and 172 (again, corresponding to the oxidizer outlet ports 146 of FIG. 3). Each of the oxidizer outlet ports 164 and 172 extends from the oxidizer flow passage 130 through the second conical surface 152. In the vented venturi of the present disclosure, a plurality of the oxidizer outlet ports 164 are arranged about the circumference of the second conical surface 152, and a plurality of the oxidizer outlet ports 172 are arranged about the circumference of the second conical surface 152. (See, e.g., FIGS. 7 and 8). The plurality of oxidizer outlet ports 164 arranged about the circumference of the second conical surface 152 may be referred to as a third row of oxidizer outlet ports, and the plurality of oxidizer outlet ports 172 arranged about the circumference of the second conical surface 152 can be referred to as a fourth row of oxidizer outlet ports. Collectively, the third and fourth rows of oxidizer outlet ports 164, 172 may be referred to as a second group of oxidizer outlet ports. In FIG. 6, the third row of oxidizer outlet ports 164 can be seen to be arranged at a radial distance 176 from the centerline axis 102 (102(*a*)), while the fourth row of oxidizer outlet ports 172 can be seen to be arranged at a radial distance 174 different from the radial distance 176.

The oxidizer outlet port 164 is seen to be aligned at an angle 168 with respect to the second conical surface 152, in the longitudinal direction (L). The oxidizer outlet port 172 is seen to be aligned at an angle 186 with respect to the second conical surface 152, in the longitudinal direction (L). The angles 168 and 186 may be the same, or they may be different from one another. In some aspects of the present disclosure, the angles 168 and 186 may have a range from twelve degrees to thirty degrees. Of course, the present disclosure is not limited to the foregoing range and other angles may be implemented instead.

While the forgoing description was made with reference to two rows of oxidizer outlet ports 162, 182 about the circumference of the first conical surface 150 of the annular wall, and two rows of the oxidizer outlet ports 164, 172 about the circumference of the second conical surface 152 of the annular wall, for a total of four rows, the present disclosure is not limited to the four rows of the oxidizer outlet ports. More specifically, the number of rows of the oxidizer outlet ports may range from three rows to eight rows of the oxidizer outlet ports. In FIG. 6, the cross-sectional view depicted therein includes seven total rows of the oxidizer outlet ports on the first conical surface 150 and the second conical surface 152. The number of rows, however, is not limited to the foregoing and the number of rows can be selected based on a desired cooling effect to be achieved.

In FIG. 6, the rounded outlet tip portion 134 includes an outlet tip portion surface 135 that is in fluid communication with the second conical angle surface 152, and the outlet tip portion surface 135 defines, at least in part, the outlet 122. In addition, the rounded outlet tip portion 134 is seen to include a tip oxidizer outlet port 160. As will be described below with regard to FIG. 7, a plurality of the tip oxidizer ports 160 may be included in the rounded outlet tip portion 134 and may be circumferentially spaced apart about a circumference of the rounded outlet tip portion 134. The tip oxidizer outlet port 160 extends from the oxidizer flow passage 130 through the rounded outlet tip portion 134. The tip oxidizer outlet port 160 is seen to be aligned at an angle 190 with respect to the centerline axis 102 (102(*a*), where the angle 190 extends radially outward and aft. Similar to the oxidizer outlet ports 164, 172, the angle 190 of the tip oxidizer outlet port may range from twelve to thirty degrees. Of course, the present disclosure is not limited to a single tip oxidizer outlet port 160 at the rounded outlet tip portion 134, and as shown in FIG. 6, a second tip oxidizer outlet port 170 may be included. Additional tip oxidizer outlet ports may also be included, depending on the cooling effect to be achieved. Of course, the present disclosure is not limited to the foregoing range and the angle 190 may be arranged at other angles instead.

Figure 7:
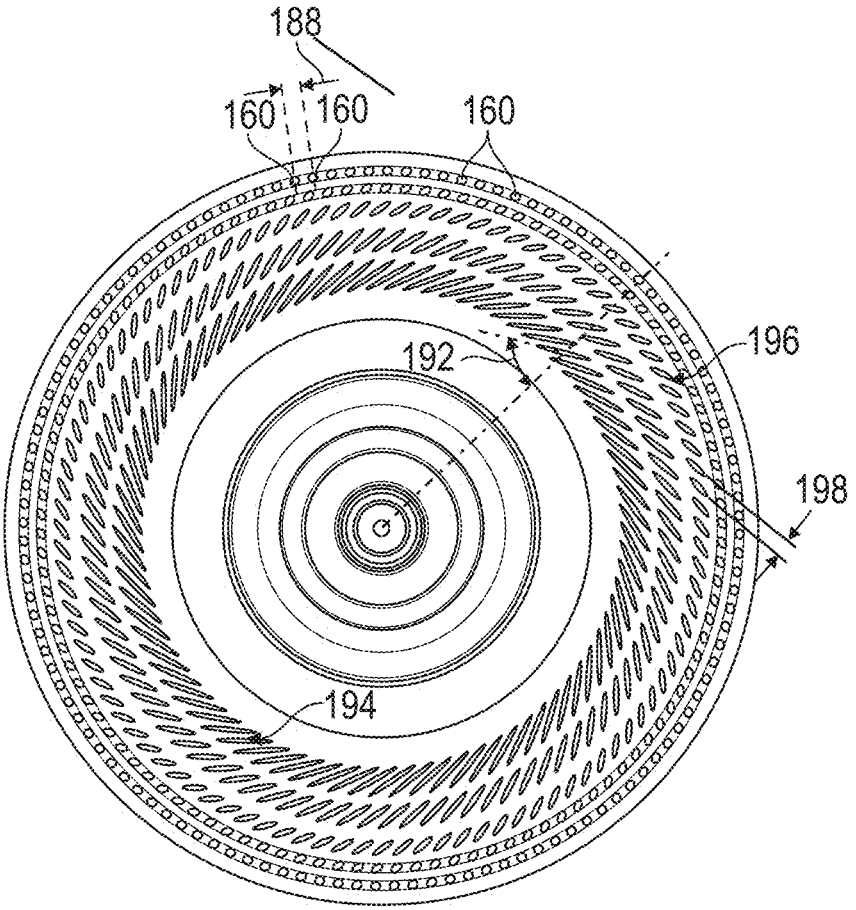
FIG. 7 is an aft, forward-looking view of a pilot fuel nozzle assembly, according to an aspect of the present disclosure.
Figure 8:
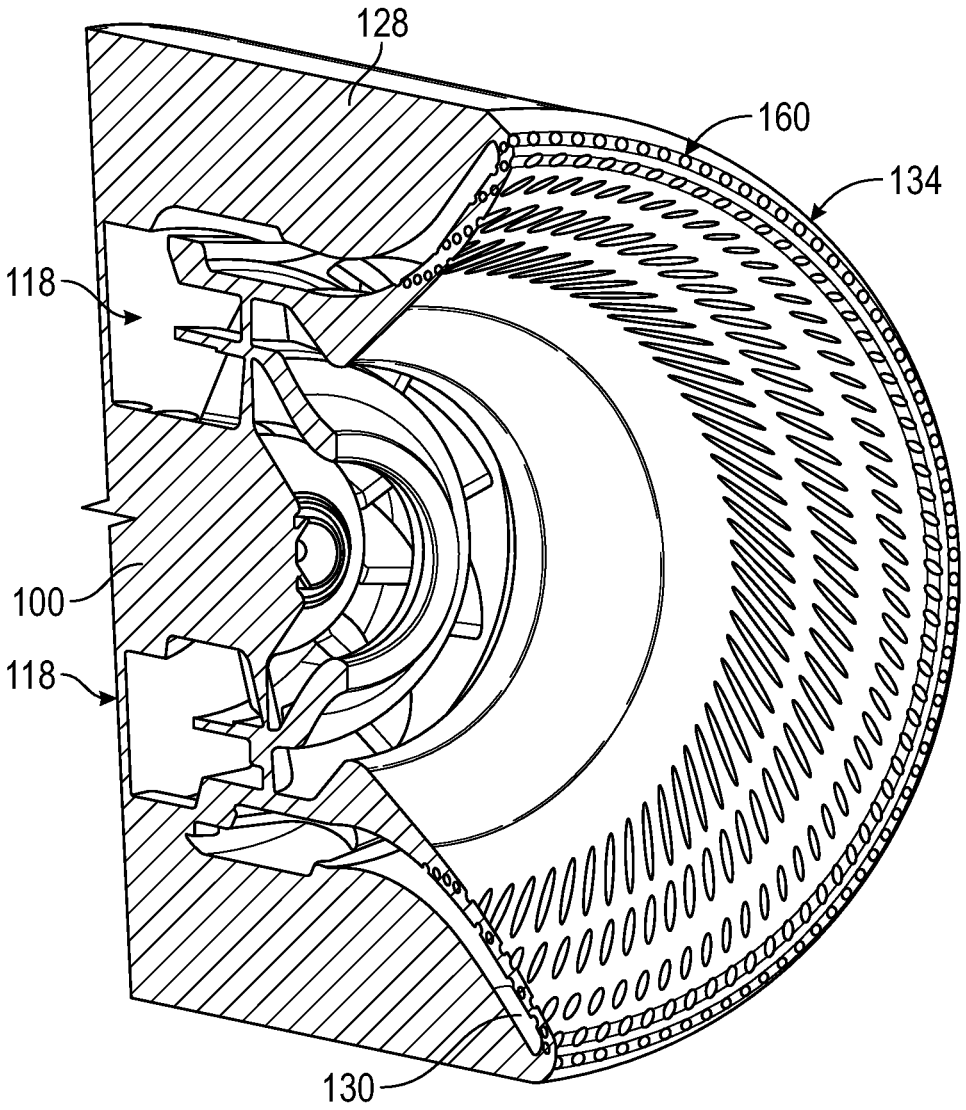
FIG. 8 is a partial perspective cross-sectional view of an exemplary pilot fuel nozzle assembly, according to yet another aspect of the present disclosure.

Referring to FIG. 7, the tip oxidizer outlet ports 160 are spaced circumferentially about the circumference of the rounded outlet tip portion 134. The circumferential spacing 188 of the tip oxidizer outlet ports 160 may be based on the size of the tip oxidizer outlet ports 160. For example, the circumferential spacing 188 may be from twice the diameter of the tip oxidizer outlet ports 160, up to six times the diameter of the tip oxidizer outlet ports 160. Here, the diameter of the tip oxidizer outlet ports 160 may be from 0.02 inches to 0.038 inches (or roughly, 0.50 mm to 0.965 mm). The foregoing spacing and outlet port diameter size may also be applicable to the oxidizer outlet ports 162, 164, 172, 182 through the first conical surface 150 and the second conical surface 152. For example, as seen in FIG. 7, the second row 196 of outlet ports may have a spacing 198 that ranges from twice the diameter up to six times the diameter of the outlet port. Of course, the spacing and size of the outlet ports are not limited to the foregoing, and other spacing or port sizes may be implemented instead, depending on the cooling effect to be achieved.

The pilot oxidizer outlet ports (e.g., oxidizer outlet ports 162, 164, 172, 182, etc.) may also be arranged at an angle with respect to the circumferential direction (C) so as to provide a swirl of the air within the venturi. For example, the pilot oxidizer outlet ports may be arranged at a co-swirl circumferential angle 192 so as to provide air flow in a co-swirl direction with respect to the pilot swirl direction. In one aspect, the co-swirl circumferential angle 192 may range from zero to sixty degrees. Of course, the co-swirl circumferential angle 192 is not limited to the foregoing range and other angles may be implemented instead, based on a desired swirl effect. In addition, while FIG. 7 depicts a single co-swirl circumferential angle 92 for the row of oxidizer outlet ports closest to the centerline axis 102, the oxidizer outlet ports arranged in rows outward of the inner-most row may also be angled in the co-swirl direction.

The vented venturi described above provides for additional cooling of the outlet end of the venturi and further mixing of oxidizer gases with the fuel/air mixture within the venturi.

While the foregoing description relates generally to a gas turbine engine, it can readily be understood that the gas turbine engine may be implemented in various environments. For example, the engine may be implemented in an aircraft, but may also be implemented in non-aircraft applications such as power generating stations, marine applications, or oil and gas production applications. Thus, the present disclosure is not limited to use in aircraft.

Further aspects of the present disclosure are provided by the subject matter of the following clauses.

A pilot fuel nozzle assembly for a combustor of a gas turbine engine, the pilot fuel nozzle assembly comprising, a pilot fuel nozzle, a pilot oxidizer inlet disposed about the pilot fuel nozzle, a pilot oxidizer swirler disposed downstream of the pilot oxidizer inlet, the pilot oxidizer swirler providing a swirling flow of oxidizer in a pilot swirl direction about a fuel nozzle centerline axis, and a vented pilot venturi disposed radially outward of the pilot oxidizer swirler and in fluid communication with the pilot oxidizer inlet, wherein the vented pilot venturi comprises, an annular wall extending circumferentially about the fuel nozzle centerline axis, and extending in a longitudinal direction along the fuel nozzle centerline axis from an inlet end of the vented pilot venturi to an outlet of the vented pilot venturi, wherein the annular wall comprises an oxidizer flow passage within the annular wall, the oxidizer flow passage extending from the inlet end of the vented pilot venturi to an outlet end of the vented pilot venturi adjacent to the outlet, and the oxidizer flow passage being in fluid communication with the pilot oxidizer inlet, wherein the annular wall defines an inner venturi surface defining an open cavity through the vented pilot venturi, the inner venturi surface including, (a) a throat area disposed between the inlet end of the vented pilot venturi and the outlet of the vented pilot venturi, the throat area having a smaller diameter than a remaining portion of the inner venturi surface downstream of the throat area, and (b) an expansion flow surface portion disposed, in the longitudinal direction, from the throat area to the outlet of the vented pilot venturi, the expansion flow surface portion have a first diameter at the throat area and a second diameter at the outlet, the second diameter being larger than the first diameter, wherein the annular wall further defines a plurality of venturi oxidizer outlet ports extending from the oxidizer flow passage through the expansion flow surface portion, the plurality of venturi oxidizer outlet ports being circumferentially spaced about the fuel nozzle centerline axis.

The pilot fuel nozzle assembly according to any preceding clause, wherein the expansion flow surface portion comprises a curved surface extending circumferentially about the fuel nozzle centerline axis.

The pilot fuel nozzle assembly according to any preceding clause, wherein the expansion flow surface portion comprises a conical-shaped surface extending circumferentially about the fuel nozzle centerline axis.

The pilot fuel nozzle assembly according to any preceding clause, wherein the expansion flow surface portion comprises a first conical-shaped portion extending, in the longitudinal direction, from the throat area to a breakpoint between the throat area and the outlet, and a second conical-shaped portion extending from the breakpoint to the outlet.

The pilot fuel nozzle assembly according to any preceding clause, wherein the first conical-shaped portion, with respect to the fuel nozzle centerline axis, has a first conical half-angle in a range from fifteen to thirty degrees, and the second conical-shaped portion, with respect to the fuel nozzle centerline axis, has a second conical half-angle in a range from thirty to forty degrees.

The pilot fuel nozzle assembly according to any preceding clause, wherein the first conical-shaped portion, with respect to the fuel nozzle centerline axis, has a first conical half-angle in a range from thirty to forty degrees, and the second conical-shaped portion, with respect to the fuel nozzle centerline axis, has a second conical half-angle in a range from fifteen to thirty degrees.

The pilot fuel nozzle assembly according to any preceding clause, wherein the outlet comprises a rounded outlet tip portion, and wherein the vented pilot venturi defines a plurality of tip oxidizer outlet ports about a circumference of the rounded outlet tip portion, and the plurality of tip oxidizer outlet ports extend from the outlet end of the oxidizer flow passage through the rounded outlet tip portion.

The pilot fuel nozzle assembly according to any preceding clause, wherein each of the plurality of tip oxidizer outlet ports are arranged at an angle extending radially outward with respect to the fuel nozzle centerline axis.

The pilot fuel nozzle assembly according to any preceding clause, wherein the plurality of venturi oxidizer outlet ports are arranged in a plurality of rows about a circumference of the expansion flow surface portion, each of the plurality of rows being disposed at a different radial distance from the fuel nozzle centerline axis.

The pilot fuel nozzle assembly according to any preceding clause, wherein a number of rows comprising the plurality of rows is in a range from three rows to eight rows.

The pilot fuel nozzle assembly according to any preceding clause, wherein the plurality of venturi oxidizer outlet ports comprises a first group of venturi oxidizer outlet ports disposed through the first conical-shaped portion, and a second group of venturi oxidizer outlet ports disposed through the second conical-shaped portion.

The pilot fuel nozzle assembly according to any preceding clause, wherein the first group of venturi oxidizer outlet ports are arranged in a plurality of rows about a circumference of the first conical-shaped portion, each of the plurality of rows of the first group of venturi oxidizer outlet ports being disposed at a different radial distance from the fuel nozzle centerline axis, wherein the second group of venturi oxidizer outlet ports are arranged in a plurality of rows about a circumference of the second conical-shaped portion, each of the plurality of rows of the second group of venturi oxidizer outlet ports being disposed at a different radial distance from the fuel nozzle centerline axis.

The pilot fuel nozzle assembly according to any preceding clause, wherein each of the venturi oxidizer outlet ports in the first group of venturi oxidizer outlet ports are arranged at a first angle with respect to the first conical-shaped portion in the longitudinal direction, and wherein each of the venturi oxidizer outlet ports in the second group of venturi oxidizer outlet ports are arranged at a second angle with respect to the second conical-shaped portion in the longitudinal direction.

The pilot fuel nozzle assembly according to any preceding clause, wherein the first angle has a range from twelve to thirty degrees, and the second angle has a range from twelve to thirty degrees.

The pilot fuel nozzle assembly according to any preceding clause, wherein the plurality of venturi oxidizer outlet ports are arranged in a row circumferentially about the expansion flow surface portion, and wherein a spacing, circumferentially, between each of the venturi oxidizer outlet ports in the row is in a range from twice a diameter of the venturi oxidizer outlet ports to six times the diameter of the venturi oxidizer outlet ports.

The pilot fuel nozzle assembly according to any preceding clause, wherein the plurality of venturi oxidizer outlet ports are arranged at a co-swirl circumferential angle with respect to a circumferential direction about the fuel nozzle centerline axis, the co-swirl circumferential angle being in a range from zero to sixty degrees, and the co-swirl circumferential angle being in a same direction as the pilot swirl direction of the pilot oxidizer swirler.

Further aspects of the present disclosure are provided by the subject matter of the following further clauses.

A vented pilot venturi for a pilot fuel nozzle assembly of a gas turbine engine, the vented pilot venturi comprising, an annular wall extending circumferentially about a venturi centerline axis, and extending in a longitudinal direction along the venturi centerline axis from an inlet end of the vented pilot venturi to an outlet of the vented pilot venturi, an oxidizer flow passage within the annular wall, the oxidizer flow passage extending from the inlet end of the vented pilot venturi to an outlet end of the vented pilot venturi adjacent to the outlet, the oxidizer flow passage having a flow passage inlet at the inlet end of the vented pilot venturi, an inner venturi surface defining an open cavity through the vented pilot venturi, the inner venturi surface including, (a) a throat area disposed between the inlet end of the vented pilot venturi and the outlet of the vented pilot venturi, the throat area having a smaller diameter than a remaining portion of the inner venturi surface downstream of the throat area, and (b) an expansion flow surface portion disposed, in the longitudinal direction, from the throat area to the outlet of the vented pilot venturi, the expansion flow surface portion have a first diameter at the throat area and a second diameter at the outlet, the second diameter being larger than the first diameter; and a plurality of venturi oxidizer outlet ports extending from the oxidizer flow passage through the expansion flow surface portion, the plurality of venturi oxidizer outlet ports being circumferentially spaced about the venturi centerline axis.

The vented pilot venturi according to any preceding clause, wherein the expansion flow surface portion comprises any one of a curved surface extending circumferentially about the venturi centerline axis.

The vented pilot venturi according to any preceding clause, wherein the expansion flow surface portion comprises a conical-shaped surface extending circumferentially about the venturi centerline axis.

The vented pilot venturi according to any preceding clause, wherein the expansion flow surface portion comprises a first conical-shaped portion extending, in the longitudinal direction, from the throat area to a breakpoint between the throat area and the outlet, and a second conical-shaped portion extending from the breakpoint to the outlet.

The vented pilot venturi according to any preceding clause, wherein the first conical-shaped portion, with respect to the venturi centerline axis, has a first conical half-angle in a range from fifteen to thirty degrees, and the second conical-shaped portion, with respect to the venturi centerline axis, has a second conical half-angle in a range from thirty to forty degrees.

The vented pilot venturi according to any preceding clause, wherein the first conical-shaped portion, with respect to the venturi centerline axis, has a first conical half-angle in a range from thirty to forty degrees, and the second conical-shaped portion, with respect to the venturi centerline axis, has a second conical half-angle in a range from fifteen to thirty degrees.

The vented pilot venturi according to any preceding clause, wherein the outlet comprises a rounded outlet tip portion, and wherein the vented pilot venturi defines a plurality of tip oxidizer outlet ports about a circumference of the rounded outlet tip portion, and the plurality of tip oxidizer outlet ports extend from the outlet end of the oxidizer flow passage through the rounded outlet tip portion.

The vented pilot venturi according to any preceding clause, wherein each of the plurality of tip oxidizer outlet ports are arranged at an angle extending radially outward with respect to the venturi centerline axis.

The vented pilot venturi according to any preceding clause, wherein the plurality of venturi oxidizer outlet ports are arranged in a plurality of rows about a circumference of the expansion flow surface portion, each of the plurality of rows being disposed at a different radial distance from the venturi centerline axis.

The vented pilot venturi according to any preceding clause, wherein a number of rows comprising the plurality of rows is in a range from three rows to eight rows.

The vented pilot venturi according to any preceding clause, wherein the plurality of venturi oxidizer outlet ports comprises a first group of venturi oxidizer outlet ports disposed through the first conical-shaped portion, and a second group of venturi oxidizer outlet ports disposed through the second conical-shaped portion.

The vented pilot venturi according to any preceding clause, wherein the first group of venturi oxidizer outlet ports are arranged in a plurality of rows about a circumference of the first conical-shaped portion, each of the plurality of rows of the first group of venturi oxidizer outlet ports being disposed at a different radial distance from the venturi centerline axis, and wherein the second group of venturi oxidizer outlet ports are arranged in a plurality of rows about a circumference of the second conical-shaped portion, each of the plurality of rows of the second group of venturi oxidizer outlet ports being disposed at a different radial distance from the venturi centerline axis.

The vented pilot venturi according to any preceding clause, wherein each of the venturi oxidizer outlet ports in the first group of venturi oxidizer outlet ports are arranged at a first angle with respect to the first conical-shaped portion in the longitudinal direction, and wherein each of the venturi oxidizer outlet ports in the second group of venturi oxidizer outlet ports are arranged at a second angle with respect to the second conical-shaped portion in the longitudinal direction.

The vented pilot venturi according to any preceding clause, wherein the first angle has a range from twelve to thirty degrees, and the second angle has a range from twelve to thirty degrees.

The vented pilot venturi according to any preceding clause, wherein the plurality of venturi oxidizer outlet ports are arranged in a row circumferentially about the expansion flow surface portion, and wherein a spacing, circumferentially, between each of the venturi oxidizer outlet ports in the row is in a range from twice a diameter of the venturi oxidizer outlet ports to six times the diameter of the venturi oxidizer outlet ports.

The vented pilot venturi according to any preceding clause, wherein the plurality of venturi oxidizer outlet ports are arranged at a co-swirl circumferential angle with respect to a circumferential direction about the venturi centerline axis, the co-swirl circumferential angle being in a range from zero to sixty degrees.

Although the foregoing description is directed to some exemplary embodiments of the present disclosure, it is noted that other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A pilot fuel nozzle assembly for a combustor of a gas turbine engine, the pilot fuel nozzle assembly comprising:

a pilot fuel nozzle defined about a fuel nozzle centerline axis;

a pilot oxidizer inlet disposed about the pilot fuel nozzle;

a pilot splitter arranged radially outward of the pilot fuel nozzle, a pilot inner air passage being defined between the pilot fuel nozzle and the pilot splitter and being in fluid communication with the pilot oxidizer inlet;

a vented pilot venturi disposed radially outward of the pilot splitter and in fluid communication with the pilot oxidizer inlet, a pilot outer air passage being defined between the pilot splitter and the vented pilot venturi, wherein the vented pilot venturi comprises, an annular wall extending circumferentially about the fuel nozzle centerline axis, and extending in a longitudinal direction along the fuel nozzle centerline axis from an inlet end of the vented pilot venturi to an outlet of the vented pilot venturi, wherein the annular wall comprises an oxidizer flow passage within the annular wall, the oxidizer flow passage extending from the inlet end of the vented pilot venturi to an outlet end of the vented pilot venturi adjacent to the outlet, and the oxidizer flow passage being in fluid communication with the pilot oxidizer inlet, wherein the annular wall defines an inner venturi surface defining an open cavity through the vented pilot venturi, the inner venturi surface including:

(a) a throat area disposed between the inlet end of the vented pilot venturi and the outlet of the vented pilot venturi, the throat area having a smaller diameter than a remaining portion of the inner venturi surface downstream of the throat area; and (b) an expansion flow surface portion disposed, in the longitudinal direction, from the throat area to the outlet of the vented pilot venturi, the expansion flow surface portion have a first diameter at the throat area and a second diameter at the outlet, the second diameter being larger than the first diameter, wherein the annular wall further defines a plurality of venturi oxidizer outlet ports extending from the oxidizer flow passage through the expansion flow surface portion, the plurality of venturi oxidizer outlet ports being circumferentially spaced about the fuel nozzle centerline axis, wherein the expansion flow surface portion comprises a first conical-shaped surface extending, in the longitudinal direction, from the throat area to a breakpoint arranged between the throat area and the outlet, the breakpoint being arranged, in the longitudinal direction along the fuel nozzle centerline axis such that a longitudinal distance from the throat area to the breakpoint is greater than a longitudinal distance from the breakpoint to the outlet, and a second conical-shaped surface extending from the breakpoint to the outlet, the first conical-shaped surface, with respect to the fuel nozzle centerline axis, being arranged at a first conical half-angle, and the second conical-shaped surface, with respect to the fuel nozzle centerline axis, being arranged at a second conical half-angle greater than the first conical half-angle, wherein the outlet of the vented pilot venturi comprises a rounded outlet tip portion having an outlet tip portion surface in fluid communication with a downstream end of the second conical-shaped surface and the outlet tip portion surface defining, at least on part, the outlet, wherein the vented pilot venturi includes a plurality of tip oxidizer outlet ports about a circumference of the rounded outlet tip portion, and the plurality of tip oxidizer outlet ports extend from the oxidizer flow passage through the rounded outlet tip portion, and wherein the rounded outlet tip portion is formed between and adjacent the second conical-shaped surface and an exterior surface of the annular wall that extends parallel to the fuel nozzle centerline axis.

2. The pilot fuel nozzle assembly according to claim 1, wherein each of the plurality of tip oxidizer outlet ports is arranged at an angle extending radially outward with respect to the fuel nozzle centerline axis.

3. The pilot fuel nozzle assembly according to claim 1, wherein the plurality of venturi oxidizer outlet ports are arranged in a row circumferentially about the expansion flow surface portion, and wherein a spacing, circumferentially, between each of the venturi oxidizer outlet ports in the row is in a range from twice a diameter of the venturi oxidizer outlet ports to six times the diameter of the venturi oxidizer outlet ports.

4. The pilot fuel nozzle assembly according to claim 1, wherein the plurality of venturi oxidizer outlet ports are arranged at a co-swirl circumferential angle with respect to a circumferential direction about the fuel nozzle centerline axis, the co-swirl circumferential angle being in a range from zero to sixty degrees.

5. The pilot fuel nozzle assembly according to claim 4, wherein a plurality of inner air passage swirl vanes are included within the pilot inner air passage, and a plurality of outer air passage swirl vanes are included within the pilot outer air passage, the plurality of inner air passage swirl vanes and the plurality of outer air passage swirl vanes being arranged to provide a co-swirled flow of oxidizer in a pilot swirl direction about the fuel nozzle centerline axis, and the co-swirl circumferential angle being in a same direction as the pilot swirl direction.

6. The pilot fuel nozzle assembly according to claim 1, wherein the plurality of venturi oxidizer outlet ports are arranged in a plurality of rows about a circumference of the expansion flow surface portion, each of the plurality of rows being disposed at a different radial distance from the fuel nozzle centerline axis.

7. The pilot fuel nozzle assembly according to claim 6, wherein a number of rows comprising the plurality of rows is in a range from three rows to eight rows.

8. The pilot fuel nozzle assembly according to claim 1, wherein the first conical-shaped surface has the first conical half-angle in a range from fifteen to thirty degrees, and the second conical-shaped surface has the second conical half-angle in a range from thirty to forty degrees.

9. The pilot fuel nozzle assembly according to claim 1, wherein the plurality of venturi oxidizer outlet ports comprises a first group of venturi oxidizer outlet ports disposed through the first conical-shaped surface, and a second group of venturi oxidizer outlet ports disposed through the second conical-shaped surface.

10. The pilot fuel nozzle assembly according to claim 9, wherein the first group of venturi oxidizer outlet ports are arranged in a plurality of rows about a circumference of the first conical-shaped surface, each of the plurality of rows of the first group of venturi oxidizer outlet ports being disposed at a different radial distance from the fuel nozzle centerline axis, wherein the second group of venturi oxidizer outlet ports are arranged in a plurality of rows about a circumference of the second conical-shaped surface, each of the plurality of rows of the second group of venturi oxidizer outlet ports being disposed at a different radial distance from the fuel nozzle centerline axis.

11. The pilot fuel nozzle assembly according to claim 9, wherein each of the venturi oxidizer outlet ports in the first group of venturi oxidizer outlet ports are arranged at a first non-perpendicular angle with respect to the first conical-shaped surface, and wherein each of the venturi oxidizer outlet ports in the second group of venturi oxidizer outlet ports are arranged at a second non-perpendicular angle with respect to the second conical-shaped surface.

12. The pilot fuel nozzle assembly according to claim 11, wherein the first non-perpendicular angle has a range from twelve to thirty degrees with respect to the first conical-shaped surface, and the second non-perpendicular angle has a range from twelve to thirty degrees with respect to the second conical-shaped surface.

13. A vented pilot venturi for a pilot fuel nozzle assembly of a gas turbine engine, the vented pilot venturi comprising:

an annular wall extending circumferentially about a venturi centerline axis, and extending in a longitudinal direction along the venturi centerline axis from an inlet end of the vented pilot venturi to an outlet of the vented pilot venturi;

an oxidizer flow passage within the annular wall, the oxidizer flow passage extending from the inlet end of the vented pilot venturi to an outlet end of the vented pilot venturi adjacent to the outlet, the oxidizer flow passage having a flow passage inlet at the inlet end of the vented pilot venturi;

an inner venturi surface defining an open cavity through the vented pilot venturi, the inner venturi surface including:

(a) a throat area disposed between the inlet end of the vented pilot venturi and the outlet of the vented pilot venturi, the throat area having a smaller diameter than a remaining portion of the inner venturi surface downstream of the throat area; and (b) an expansion flow surface portion disposed, in the longitudinal direction, from the throat area to the outlet of the vented pilot venturi, the expansion flow surface portion have a first diameter at the throat area and a second diameter at the outlet, the second diameter being larger than the first diameter; and a plurality of venturi oxidizer outlet ports extending from the oxidizer flow passage through the expansion flow surface portion, the plurality of venturi oxidizer outlet ports being circumferentially spaced about the venturi centerline axis, wherein the expansion flow surface portion comprises a first conical-shaped surface extending, in the longitudinal direction, from the throat area to a breakpoint arranged between the throat area and the outlet, the breakpoint being arranged, in the longitudinal direction along the venturi centerline axis such that a longitudinal distance from the throat area to the breakpoint is greater than a longitudinal distance from the breakpoint to the outlet, and a second conical-shaped surface extending from the breakpoint to the outlet, the first conical-shaped surface, with respect to the venturi centerline axis, being arranged at a first conical half-angle, and the second conical-shaped surface, with respect to the venturi centerline axis, being arranged at a second conical half-angle greater than the first conical half-angle, wherein the outlet of the vented pilot venturi comprises a rounded outlet tip portion having an outlet tip portion surface in fluid communication with a downstream end of the second conical-shaped surface and the outlet tip portion surface defining, at least in part, the outlet, wherein the vented pilot venturi includes a plurality of tip oxidizer outlet ports about a circumference of the outlet, and the plurality of tip oxidizer outlet ports extend from the oxidizer flow passage through the rounded outlet tip portion, and wherein the rounded outlet tip portion is formed between and adjacent the second conical-shaped surface and an exterior surface of the annular wall that extends parallel to the venturi centerline axis.

14. The vented pilot venturi according to claim 13, wherein the plurality of venturi oxidizer outlet ports are arranged in a plurality of rows about a circumference of the expansion flow surface portion, each of the plurality of rows being disposed at a different radial distance from the venturi centerline axis.

15. The vented pilot venturi according to claim 13, wherein the first conical-shaped surface has the first conical half-angle in a range from fifteen to thirty degrees, and the second conical-shaped surface has the second conical half-angle in a range from thirty to forty degrees.

16. The vented pilot venturi according to claim 13, wherein the plurality of venturi oxidizer outlet ports comprises a first group of venturi oxidizer outlet ports disposed through the first conical-shaped surface, and a second group of venturi oxidizer outlet ports disposed through the second conical-shaped surface.

17. The vented pilot venturi according to claim 16, wherein each of the venturi oxidizer outlet ports in the first group of venturi oxidizer outlet ports are arranged at a first non-perpendicular angle with respect to the first conical-shaped surface, and wherein each of the venturi oxidizer outlet ports in the second group of venturi oxidizer outlet ports are arranged at a second non-perpendicular angle with respect to the second conical-shaped surface.

* * * * *